US006112785A

United States Patent [19]

Yu

[11] Patent Number: 6,112,785

[45] Date of Patent: Sep. 5, 2000

[54] WORK TABLE HAVING AUXILIARY SLIDING TABLE

[76] Inventor: Ben Yu, No. 12, Lane 204, Jih San Road, Hsi Tun Chu, Taichung 407, Taiwan

[21] Appl. No.: 09/413,334

[22] Filed: Oct. 12, 1999

[51] Int. Cl.[7] ..... B25H 1/00

[52] U.S. Cl. ..... 144/287; 83/477.2; 108/65; 144/286.1

[58] Field of Search ..... 83/435.11, 435.27, 83/477.2; 144/1.1, 286.1, 286.5, 287; 108/59, 61, 65, 69; 269/289 R, 296, 292

[56] References Cited

U.S. PATENT DOCUMENTS

| | | | |
|---|---|---|---|
| 746,972 | 12/1903 | Marsh | 144/287 |
| 1,048,596 | 12/1912 | Sedaj | 144/287 |
| 1,583,879 | 5/1926 | Hallock | 144/287 |
| 4,248,115 | 2/1981 | Brodbeck et al. | 83/435.11 |
| 4,830,076 | 5/1989 | Feyer | 83/477.2 |

*Primary Examiner*—W. Donald Bray
*Attorney, Agent, or Firm*—Charles E. Baxley, Esq.

[57] ABSTRACT

A work table includes a pivotal arm, a track, and a sliding table slidably engaged on the track. One or more pairs of wheels are supported on the arm for slidably supporting a pole which is extendible relative to the arm. The pole includes a free end portion coupled to the suspended portion of the sliding table to support the suspended portion of the sliding table in place. The wheels may include a peripheral recess for stably receiving the pole. A barrel is secured to the pole, and a pin is secured to the sliding table and engaged in the barrel for supporting the sliding table.

8 Claims, 5 Drawing Sheets

WORK TABLE HAVING AUXILIARY SLIDING TABLE

BACKGROUND OF THE INVENTION

1. Field of the Invention

The present invention relates to a work table, and more particularly to a work table having an auxiliary sliding table.

2. Description of the Prior Art

Typical work tables may be used for supporting the table saws. A sliding table may be provided for supporting and feeding the work pieces through the table saw. However, the sliding table may not be stably supported in place to the work table.

The present invention has arisen to mitigate and/or obviate the afore-described disadvantages of the conventional work tables.

SUMMARY OF THE INVENTION

The primary objective of the present invention is to provide a work table having an auxiliary sliding table that may be stably secured to the work table.

In accordance with one aspect of the invention, there is provided a work table comprising a table body, a track secured to the table body, a sliding table slidably engaged on the track and slidable along the track, the sliding table including a suspended portion, an arm pivotally secured to the table body at a pivot shaft, the arm including a wheel assembly provided thereon, a pole slidably secured to the arm at the wheel assembly and slidable and extendible relative to the arm, the pole including a free end portion, and means for coupling the free end portion of the pole to the suspended portion of the sliding table to support the suspended portion of the sliding table in place.

The wheel assembly includes at least two pairs of wheels provided on the arm for slidably receiving the pole, and includes two bars secured on the arm for supporting the wheels. The wheels may include a peripheral recess for stably receiving the pole.

The coupling means includes a barrel secured to the free end portion of the pole, a rod having a first end secured to the suspended portion of the sliding table and having a second end engaged into the barrel. The coupling means further includes a bolt adjustably threaded to the barrel and engaged with the rod. The rod includes two segments pivotally coupled together at a pivot pin for allowing the segments to be rotated relative to each other about the pivot pin.

The table body includes a bottom portion having at least one footing beam extended from the bottom portion thereof and located below the sliding table for supporting the sliding table.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
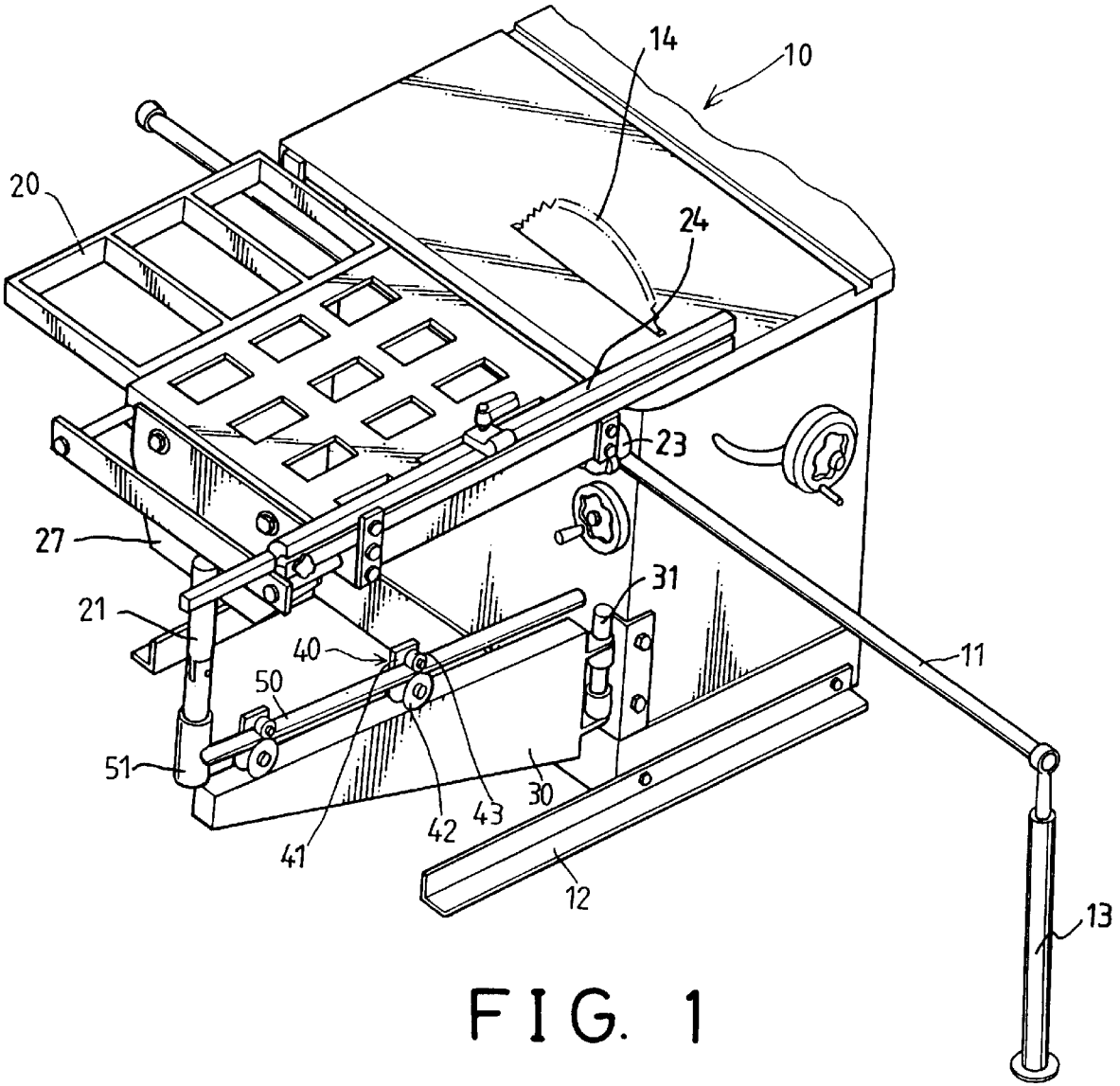
FIG. 1 is a perspective view of a work table in accordance with the present invention.
Figure 2:
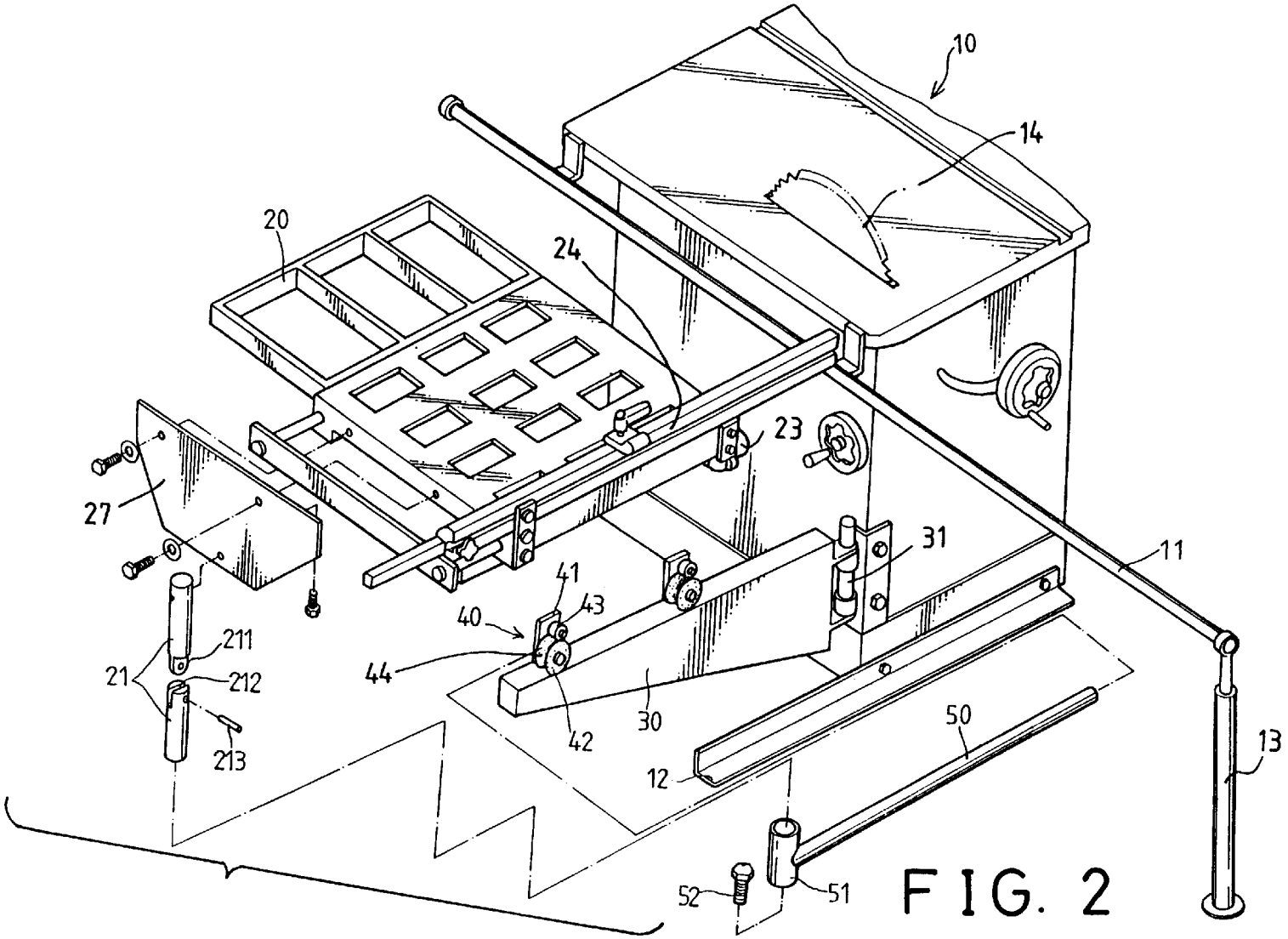
FIG. 2 is an exploded view of the sliding table for the work table.

Referring to the drawings, and initially to FIGS. 1 and 2, a work table in accordance with the present invention comprises a table body 10 for supporting a table saw 14, for example. The table body 10 includes a longitudinal track 11 secured to one side portion thereof and preferably supported in place by a stay 13 for slidably supporting an auxiliary sliding table 20 , and includes one or more footing beams 12 secured to the bottom and extended outward from the bottom thereof and located below the sliding table 20 for forming a stable support to the sliding table 20 . The sliding table 20 is slidably secured to the track 11 with the typical couplers and/or rollers and/or wheels 23. The sliding table 20 itself includes a guide device 24 for supporting and for guiding the work pieces through the table saw 14. The sliding table 20 includes a flap 27 secured thereto, and includes a rod 21 having an upper portion secured to the sliding table 20 at the flap 27. The rod 21 preferably includes two segments pivotally secured together at a pivot pin 213. One of the segments of the rod 21 includes a tongue 211 rotatably engaged into a slot 212 that is formed in the other segment of the rod 21 before the pivot pin 213 is engaged through the two segments of the rod 21.

Figure 3:
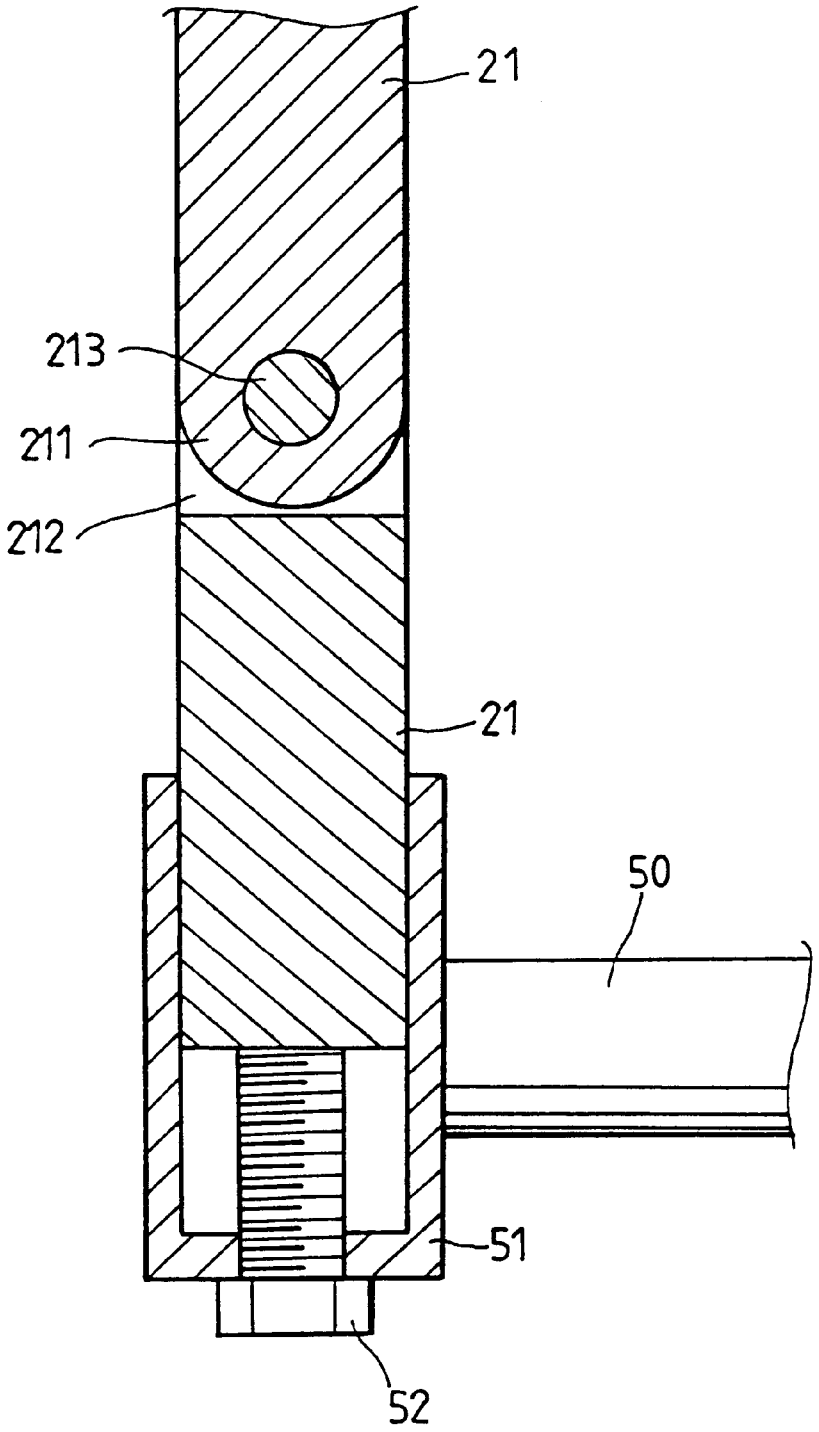
FIG. 3 is a cross sectional view taken along lines 3—3 of FIG. 4.

An arm 30 is pivotally secured to the table body 10 at a pivot shaft 31, and includes one or more wheel assemblies 40 secured thereon for slidably supporting a pole 50. The wheel assemblies 40 each includes a bar 41 extended upward from the arm 30, and a primary wheel 42 and an auxiliary wheel 43 rotatably secured to said bar 41. The primary wheel 42 includes a peripheral recess 44 formed therein for receiving the pole 50. The auxiliary wheels 43 are engaged with the pole 50 for stably retaining the pole 50 in the primary wheels 42 and for preventing the pole 50 from being disengaged from the wheel assemblies 40. The pole 50 includes a barrel 51 secured to the free end thereof for slidably receiving the lower portion of the rod 21, and a bolt 52 is threaded to the bottom portion of the barrel 51 and is extended inward of the barrel 51 for engaging with the rod 21 (FIG. 3). The rod 21 is provided for supporting the suspended or the free end portion of the sliding table 20 , and the barrel 51 is provided for supporting the rod 21 and thus for stably supporting the sliding table 20 in place. The bolt 52 may be adjusted relative to the barrel 51 to engage with the rod 21 and to stably support the sliding table 20 in place.

Figure 4:
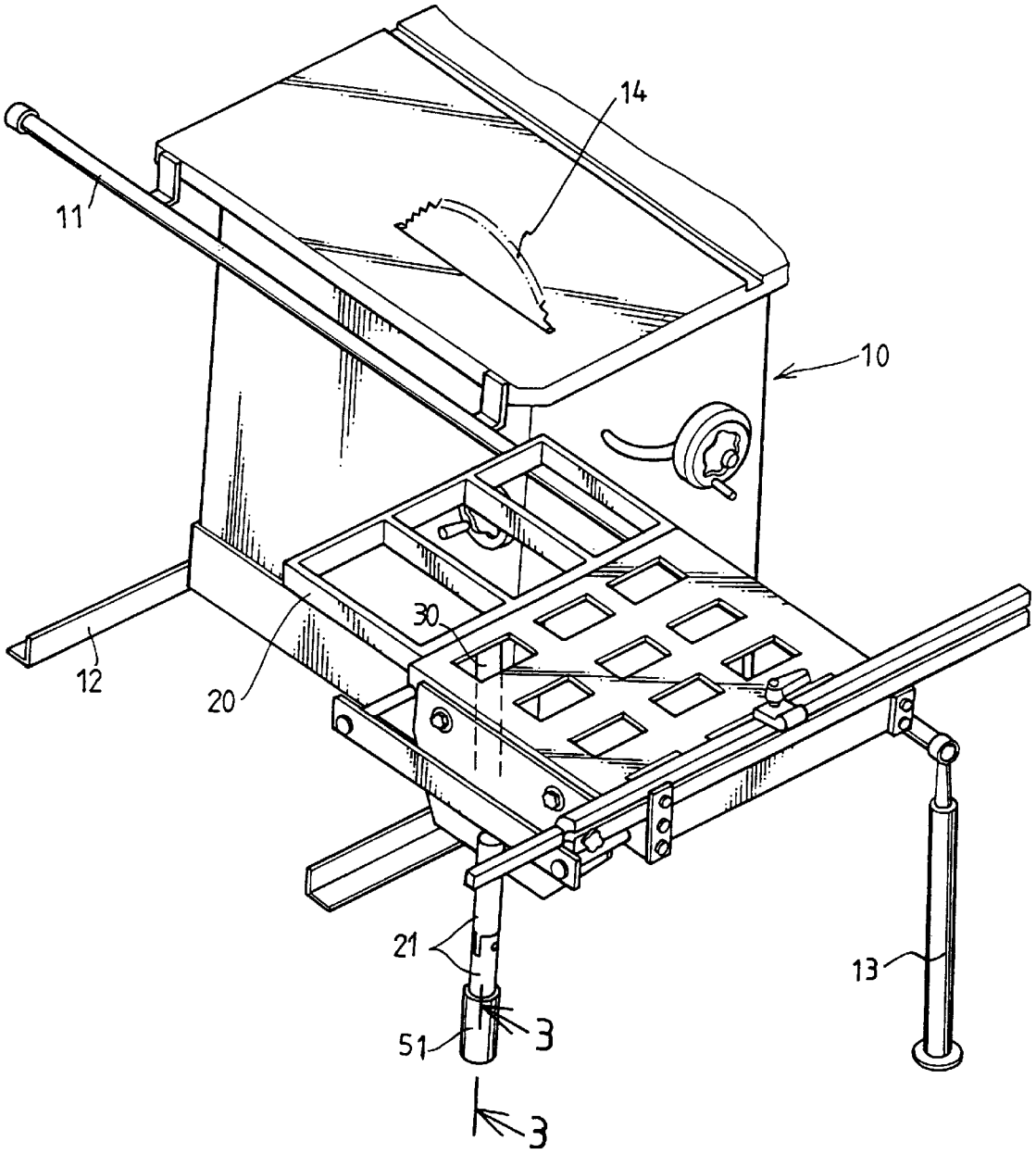
FIG. 4 is a perspective view illustrating the operation of the work table.
Figure 5:
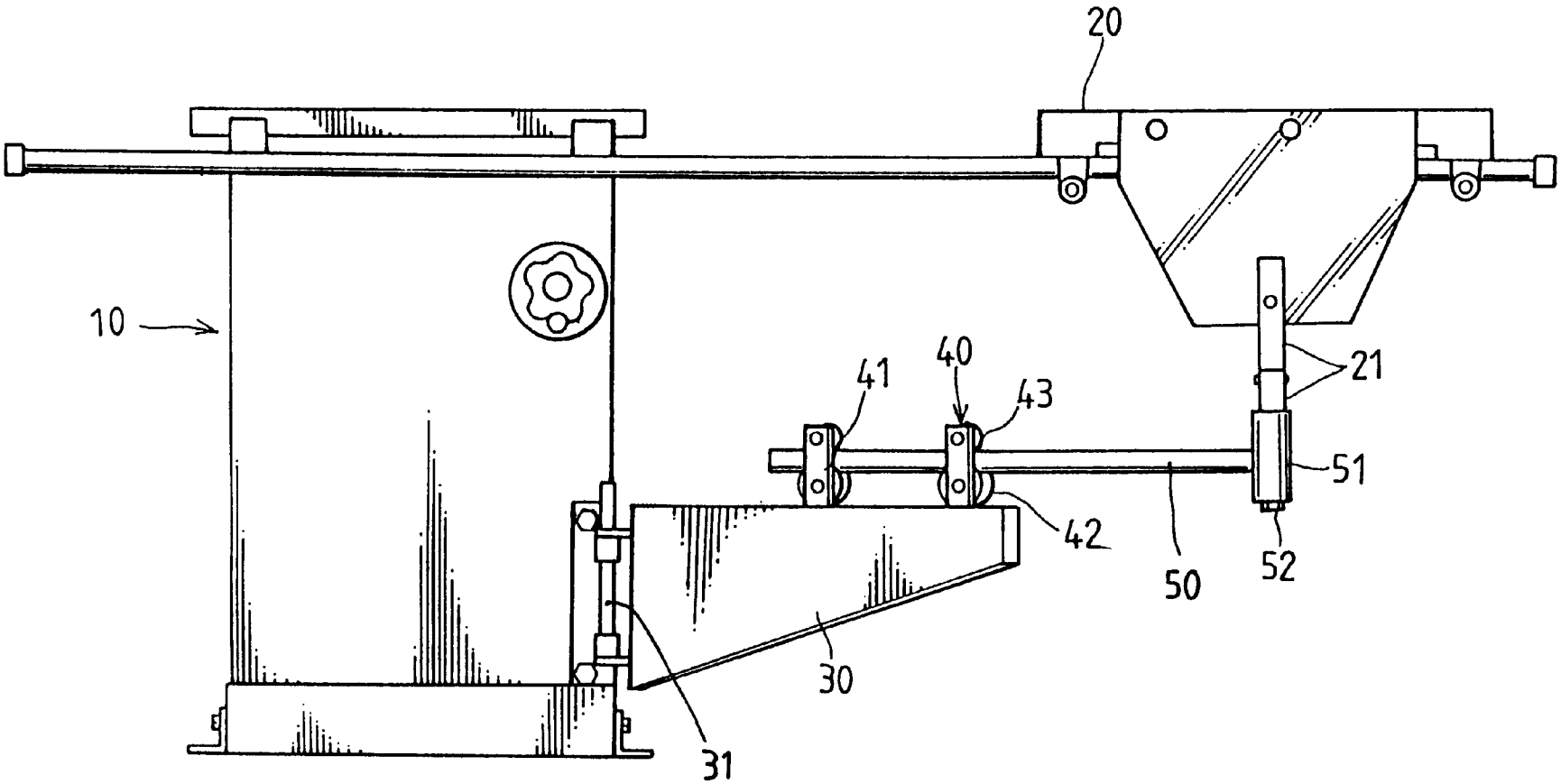
FIG. 5 is a plane view illustrating the operation of the work table.

In operation, as shown in FIGS. 4 and 5, when the sliding table 20 is slided along the track 11, the arm 30 may be rotated about the pivot shaft 31 and the pole 50 may be slided and extended relative to the arm 30 to stably support the sliding table 20 in place. The pole 50 will not be easily disengaged from the wheel assemblies 40. The two segments of the rod 21 allows the two segments of the rod 21 to be rotated relative to each other and allows the lower portion of the rod 21 to be engaged into the barrel 51.

Accordingly, the work table in accordance with the present invention includes an auxiliary sliding table that may be stably secured to the work table.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A work table comprising:

a table body, a track secured to said table body, a sliding table slidably engaged on said track and slidable along said track, said sliding table including a suspended portion, an arm pivotally secured to said table body at a pivot shaft, said arm including a wheel assembly provided thereon, a pole slidably secured to said arm at said wheel assembly and slidable and extendible relative to said arm, said pole including a free end portion, and means for coupling said free end portion of said pole to said suspended portion of said sliding table to support said suspended portion of said sliding table in place.

2. The work table according to claim 1, wherein said wheel assembly includes at least two pairs of wheels provided on said arm, said pole is slidably engaged between said pairs of wheels.

3. The work table according to claim 2, wherein said wheel assembly includes two bars secured on said arm, said at least two pairs of wheels are rotatably secured to said bars respectively.

4. The work table according to claim 3, wherein said at least two pairs of wheels each includes a wheel having a peripheral recess formed therein for stably receiving said pole.

5. The work table according to claim 1, wherein said coupling means includes a barrel secured to said free end portion of said pole, a rod having a first end secured to said suspended portion of said sliding table and having a second end engaged into said barrel.

6. The work table according to claim 5, wherein said coupling means further includes a bolt adjustably threaded to said barrel and engaged with said rod.

7. The work table according to claim 5, wherein said rod includes two segments pivotally coupled together at a pivot pin for allowing said segments to be rotated relative to each other about said pivot pin.

8. The work table according to claim 1, wherein said table body includes a bottom portion having at least one footing beam extended from said bottom portion thereof and located below said sliding table for supporting said sliding table.

* * * * *